United States Patent [19]

Fort et al.

[11] 4,004,632

[45] Jan. 25, 1977

[54] CENTRIFUGAL CASTING MACHINE CASING AND COOLING APPARATUS

[75] Inventors: Pierre Henri Marie Fort, Nancy; Michel Pierrel, Pont-a-Mousson, both of France

[73] Assignee: Pont-A-Mousson S.A., Nancy, France

[22] Filed: Apr. 11, 1975

[21] Appl. No.: 567,334

[30] Foreign Application Priority Data

Apr. 29, 1974 France ..... 74.14868

[52] U.S. Cl. ..... 164/297; 164/118

[51] Int. Cl.² ..... B22D 13/02

[58] Field of Search ..... 164/89, 297, 298, 283 MS, 164/348, 152, 153, 118; 425/73, 74

[56] References Cited

UNITED STATES PATENTS

| | | | |
|---|---|---|---|
| 1,796,645 | 3/1931 | Carrington | 164/297 |
| 1,916,296 | 7/1933 | Barr et al. | 164/299 X |
| 3,457,986 | 7/1969 | Andrews | 164/348 X |

*Primary Examiner*—Richard B. Lazarus
*Assistant Examiner*—Gus T. Hampilos
*Attorney, Agent, or Firm*—Sughrue, Rothwell, Mion, Zinn & Macpeak

[57] ABSTRACT

The machine comprises a casing, a rotary casting mould and means for spraying cooling water onto the mould. A tubular duct is secured to the inside of the casing and opens into the interior of the casing and is for connection to a forced suction means.

8 Claims, 3 Drawing Figures

CENTRIFUGAL CASTING MACHINE CASING AND COOLING APPARATUS

The present invention relates to a machine for centrifugally casting iron pipes of the type comprising a casing, a rotary mould and means for spraying cooling water on the mould, and more particularly relates to a casing for such a machine.

Known machines of this type comprise a casing provided with an opening at each end for the passage of the mould ends. The steam, which is formed rapidly in a large amount when sparying cooling water on the mould during the centrifugal casting of the iron, escapes by way of all the gaps and openings of the casing and fills the workshop and is liable to hinder, if not scold, the personnel.

An object of the present invention is to overcome this drawback by providing a machine of the aforementioned type equipped with a casing adapted to prevent escape of the steam to the exterior.

According to the invention there is provided a machine for centrifugally casting iron pipes, wherein the casing is provided with at least one tubular duct integral with the inner wall of the casing and opening into the latter and capable of being connected to forced suction means.

According to a preferred embodiment of the invention, in which the casing of the machine is movable in translation in a direction parallel to the axis of the mould, the machine comprises at least one first duct integral with the casing and communicating with the interior of the casing by way of an opening, at least one second duct which is fixed relative to the ground, means for interconnecting in a sealed mannner the first and second ducts in at least one given position of the casing, and means for a forced suction of the steam disposed in one of the ducts.

With this arrangement, the casing of the machine constitutes a veritable steam suction hood.

Further features and advantages of the invention and its operation will be described hereinafter with reference to the accompanying drawings given by way of example and in which.

Figure 1:
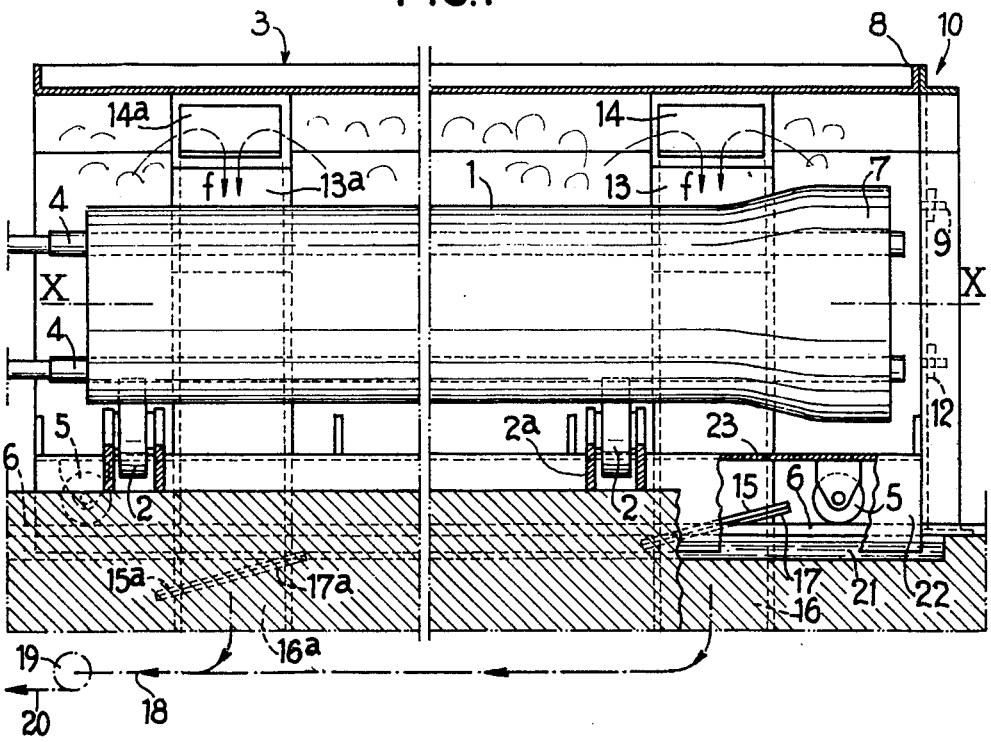
FIG. 1 is a diagrammatic sectional view, with parts cut away, of the centrifugal casting machine according to the invention provided with a movable casing which is shown in its operative working position.
Figure 2:
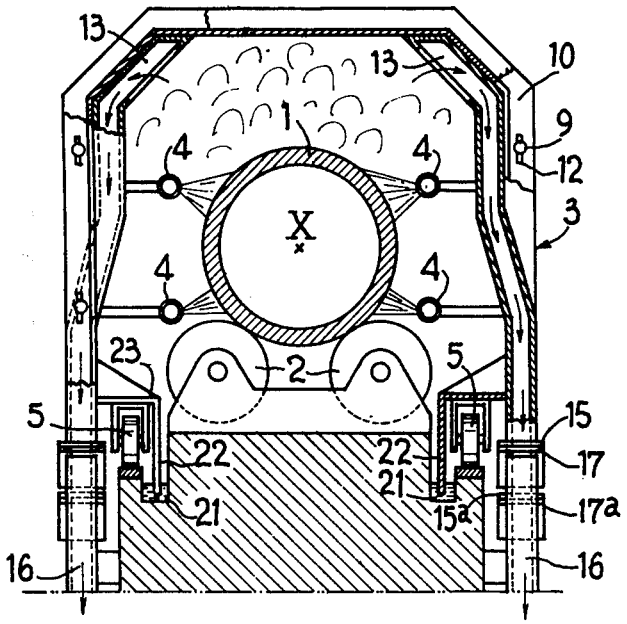
FIG. 2 is an end view, with parts cut away, of said machine casing.
Figure 3:
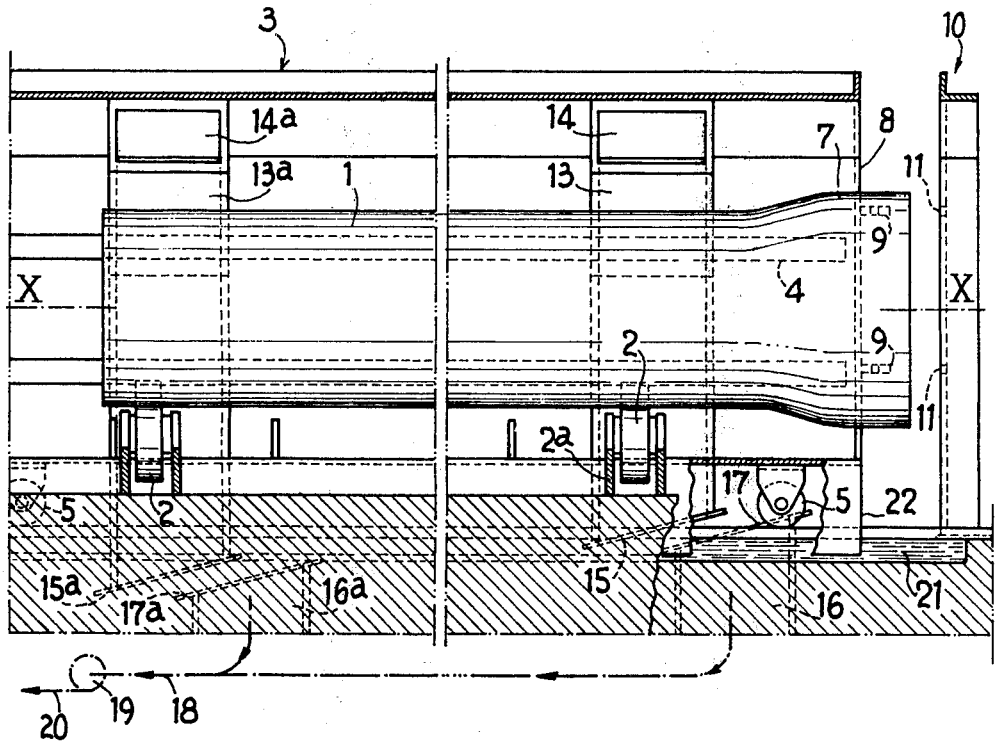
FIG. 3 is a view corresponding to FIG. 1 of the casing in the course of disengagement for completely uncovering the casting mould.

FIGS. 1 to 3 show partly one embodiment of a machine for centrifugally casting iron pipes comprising a mould 1 having a horizontal, or substantially horizontal, axis X—X carried by rollers 2 rotatably mounted on support means 2*a* fixed to the ground. A movable casing 3 having an axis X—X constitutes a tunnel which has a vault or roof connected to two vertical lateral walls and is wide open at both ends, and is spacious enough to house the mould 1 entirely therein when the casing is placed in its operative position of the machine shown in FIG. 1.

These Figures do not show the motor driving the rollers 2, the pouring trough and the cast pipe extracting device, since these various parts are well known and have no direct connection with the invention.

Water spraying systems 4, for example four systems, are disposed around the mould 1 parallel to its generatrices and to the axis X—X.

According to the invention, the movable casing 3 is provided internally on each of its lateral walls with rollers 5 which roll along runways 6 parallel to the axis X—X.

Adjacent the socket 7 of the mould 1 the casing 3 has at its leading end relative to its movement a fixing flange 8 provided with axial pins 9.

A gantry 10, having a cross-sectional shape and size corresponding to the cross-sectional shape and size of the casing 3, is provided adjacent the socket 7 of the mould 1 at a point determining the extreme advanced position of the casing 3. The gantry 10 is provided with apertures 11 which are in axial alignment with the pins 9 of the flange 8 and keys 12 which, when the casing 3 is advanced to its working position, cooperate with the pins 9 so as to lock the casing 3 and gantry 10 together.

The casing 3 has internally two pairs of ducts or pipings 13 and 13*a* which are substantially vertical and disposed along the lateral walls of the casing 3. The ducts 13 are disposed symmetrically with respect to the axis X—X on each of the inner lateral walls of the casing 3 adjacent the leading end of the casing having the fixing flange 8, the ducts 13*a* being disposed in an identical manner inside the casing 3 adjacent the other end or trailing end of the latter. The four ducts 13, 13*a* are bent so that their lower part is disposed in the extension of the lateral walls of the casing. Preferably, the ducts 13, 13*a* have a rectangular section and are flattened so as to reduce the space they consume inside the casing 3. The ducts 13, 13*a* each have in their upper part, near the vault of the casing 3, a steam inlet aperture 14, 14*a* and in their lower part an inclined flange 15, 15*a* which are perpendicular to a vertical axial plane. Each flange 15, 15*a* is upwardly inclined toward the gantry 10, that is to say, forwardly if the end in which the gantry 10 and socket 7 of the mould 1 are placed is called the front end. Further, the front flanges 15 which are nearest to the gantry 10 have their lower edge located at a slightly higher level than that of the upper edge of the flanges 15*a* and are aligned with the flanges 15*a* in a direction parallel to the axis X—X.

Two pairs of ducts 16 and 16*a* fixed to the ground on each side of the casing 3 have respectively flanges 17 and 17*a* having the same inclination as the flanges 15, 15*a* and disposed at the same distance from the side of the gantry 10 facing the casing 3 as the flanges 15 and 15*a* are respectively from the end of the casing 3 facing the gantry 10.

The flanges 17 and 17*a* are in longitudinal alignment in pairs on each side of the casing 3 with the flanges 15 and 15*a*. The flanges 17*a* have their upper edge disposed at a lower level than that of the lower edge of the flanges 17 or of the flanges 15 so that when the casing withdraws or advances the flanges 15 can pass over the flanges 17*a*.

Consequently, when the casing is in its working position with its flanges 8 bearing against the gantry 10, the flanges 15 and 17, on one hand, and the flanges 15*a* and 17*a*, on the other, bear against each other and coincide exactly owing to identical inclination and spacing. A sealed connection between the ducts 13, 13*a* and the ducts 16, 16*a* is thus achieved.

The fixed ducts 16 and 16*a* are connected to a tubular manifold 18 shown in dot-dash line which is connected to the inlet side of a fan 19 which discharges at 20 to a flue (not shown).

According to the invention, a steam seal is ensured in the lower part of the machine adjacent the ground by a pair of channels 21 containing water and parallel to the axis X—X and disposed along the runways 6 and between the later. Movable in each channel 21 is a vertical deflecting plate 22 connected by a horizontal wall 23 to each lateral wall of the casing 3, the plates 22 and 23 extending throughout the length of the casing 3.

Each deflecting plate 22 is partly immersed in each channel 21 and constitutes therein a mobile hydraulic seal.

This machine operates in the following manner:

For casting iron, the casing 3 is in the position shown in FIGS. 1 and 2 in which it is fixed to the gantry 10. The fixing pins 9 are locked by the keys 12. The movable steam ducts 13, 13*a* are connected to the fixed ducts 16, 16*a* by their respective flanges 15, 15*a* and 17, 17*a*.

In the course of the casting, water is sprayed onto the mould 1 throughout the length of the latter by the spraying systems 4 so as to cool the mould, which may be provided with a suitable covering, for example of refractory type.

Owing to the temperature of the mould, the water vaporises in contact with the mould and a part of the steam formed is condensed in the channels 21. Another part, which is the major part, of the steam is drawn off through the upper apertures in the direction of arrows *f* and flows through the ducts 13 and 13*a*, the fixed ducts 16 and 16*a*, the manifold 18, the fan 19 and is then discharged at 20 to the suction flue. No steam escapes to the exterior through the large openings or entrances of the casing 3, the latter constituting an excellent suction hood in which the hydraulic seals, constituted by the channels 21 and the plates 22 and 23, prevent the steam from escaping in the downward direction.

The personnel is consequently fully shielded from the steam whence very pleasant working conditions and appreciable saftey.

When the centrifugal casting machine is at rest and there is not casting, if it is desired to dismantle the mould 1 for inspection or replacing it by another mould of a different diameter, it must be completely uncovered for raising it and withdrawing it from above and also bringing the new mould into position from above.

For this purpose, the casing 3 is unlocked by removing the locking keys 12 from the pins 9 by striking them with a hammer. The casing 3 is then released from the gantry 10 (FIG. 3). The casing 3 is moved back (manually, with the aid of a winch or in driving at least one roller 5 of the casing 3). Owing to the inclination of the flanges 15, 15*a* and 17, 17*a*, the ducts 13, 13*a* connected to the casing 3 easily separate from the fixed ducts 16, 16*a*.

In order to completely uncover the mould 1 (a start of the uncovering is shown at the right end of FIG. 3), the casing 3 must be moved further back. The front ducts 13 and their flanges 15 then pass over the rear fixed ducts 16*a* and their flanges 17*a*, this being possible owing to the higher level of the front flanges 15 relative to the rear flanges 17*a*.

To return the casing 3 to the working position, it is moved in translation in the opposite direction, that is to say toward the gantry 10, and, when the pins 9 are engaged in the gantry 10, they are locked by the keys 12. In the course of the movements of the casing 3, the deflecting plates 22 easily travel along the channels 21.

It will be understood that many modifications may be made in this embodiment, described merely by way of example, without departing from the scope of the invention.

By way of a modification, the casing may have two parallel lateral walls, namely an outer wall and an inner wall spaced apart to the extent of the thickness of the suction ducts 13, 13*a*, so that the ducts are invisible from the interior of the casing 3 and the steam inlet apertures 14, 14*a* are flush with the inner wall.

In another modification, the casing 3 of the machine is fixed and the ducts 13 and 13*a* then constitute the extension of the fixed ducts 16 and 16*a*.

Having now described our invention that we claim as new and desire to secure by Letters Patent is:

1. A machine for centrifugally casting iron pipes comprising support means, a casing, a rotary casting mould supported on the support means and rotatable about an axis, the casing being movable in translation in a direction parallel to said axis relative to the support means between a withdrawn position and an operative position in which operative position the casing surrounds the mould substantially throughout the length of the mould, the casing having a leading end and a trailing end relative to the movement of the casing to said operative position, means for spraying cooling water onto the mould, a first duct and a second duct carried by the casing respectively adjacent the leading end and the trailing end of the casing, each duct having an oulet opening onto the interior of the casing and a transverse annular end surface defining an inlet, a third duct and a fourth duct which are fixed relative to the support means, each third and fourth duct having a transverse annular end surface defining an outlet, and forced steam suction means disposed in the third and fourth ducts, the end surfaces of the first and second ducts being respectively parallel to the end surfaces of the third and fourth ducts and positioned relative to the casing to respectively coincide with and sealingly engage the end surfaces of the third and fourth ducts in the operative position of the casing, the end surfaces of the ducts being inclined relative to said axis in a direction to permit the end surfaces of the first and second ducts to disengage from the end surfaces of the third and fourth ducts when the casing moves to said withdrawn position, and the end surfaces of the first and third ducts being offset transversely of said axis from the end surfaces of the second and third ducts whereby the end surface of the first duct clears the end surface of the fourth duct when the casing moves to said withdrawn position.

2. A machine for centrifugally casting iron pipes comprising support means, a casing, a rotary casting mould supported on the support means and rotatable about an axis, the casing being movable in translation in a direction parallel to said axis relative to the support means between a withdrawn position and an operative position in which operative position the casing surrounds the mould substantially throughout the length of the mould, the casing having a leading end and a trailing end relative to the movement of the casing to said operative position, means for spraying cooling water onto the mould, a first duct and a second duct carried by the casing respectively adjacent the leading end and the trailing end of the casing, each duct having an outlet opening onto the interior of the casing and a transverse annular end surface defining an inlet, a third duct and a fourth duct which are fixed relative to the support means, each third and fourth duct having a transverse annular end surface defining an outlet, and forced steam suction means disposed in the third and fourth ducts, the end surfaces of the first and second ducts being respectively parallel to the end surfaces of the third and fourth ducts and positioned relative to the casing to respectively coincide with and sealingly engage the end surfaces of the third and fourth ducts in the operative position of the casing, the end surfaces of the ducts being inclined relative to said axis in a direction to permit the end surfaces of the first and second ducts to disengage from the end surfaces of the third and fourth ducts when the casing moves to said withdrawn position, and the end surfaces of the first and third ducts being higher than the end surfaces of the second and third ducts whereby the end surface of the first duct clears the end surface of the fourth duct when the casing moves to said withdrawn position.

3. A machine as claimed in claim 1, wherein the first duct and second duct each have an end portion which projects from a lateral wall of the casing and terminates in said inlets and said annular end surfaces are planar surfaces on annular flanges of the ducts, means being provided for securing the casing in said operative position in a detachable manner.

4. A machine as claimed in claim 1, wherein the end surfaces are planar surfaces and perpendicular to an axial plane of the mould and inclined with respect to the axis of the mould.

5. A machine as claimed in claim 1, wherein said first, second, third, and fourth ducts are disposed on one lateral side of the casing and similar first, second, third and fourth ducts with their annular end surfaces and inlets and outlets are provided on an opposite lateral side of the casing, suction means being disposed in said similar third and fourth ducts.

6. A machine as claimed in claim 1, wherein the casing has lateral walls each of which lateral walls carries in a steam-tight manner a continuous deflecting plate which is parallel to the axis of the mould and extends substantially throughout the length of the casing, said plate having a substantially vertical part, there being provided two channels which contain water and are parallel to the axis of the mould, and the substantially vertical parts of the two deflecting plates being respectively immersed in the water of the two channels to form a seal.

7. A machine as claimed in claim 1, comprising a gantry disposed transversely of said axis and aligned with the casing and means for locking the leading end of the casing to the gantry when they engage each other in the operative position of the casing.

8. A machine as claimed in claim 7, wherein said leading end of the casing is provided with a transverse flange having axial pins, the gantry having apertures in axial alignment with the pins and keys cooperating with the pins when the pins are engaged in the apertures in said operative position of the casing.

* * * * *